US006269496B1

(12) United States Patent
Kuenkes

(10) Patent No.: US 6,269,496 B1
(45) Date of Patent: Aug. 7, 2001

(54) CRIB

(76) Inventor: Detlef Kuenkes, Loehnener Kirchweg 6, 46562 Voerde (DE)

( * ) Notice: Subject to any disclaimer, the term of this patent is extended or adjusted under 35 U.S.C. 154(b) by 0 days.

(21) Appl. No.: 09/529,921

(22) PCT Filed: Nov. 6, 1998

(86) PCT No.: PCT/DE98/03241

§ 371 Date: Apr. 21, 2000

§ 102(e) Date: Apr. 21, 2000

(87) PCT Pub. No.: WO99/23917

PCT Pub. Date: May 20, 1999

(30) Foreign Application Priority Data

Nov. 10, 1997 (DE) ..... 197 49 454
Sep. 16, 1998 (DE) ..... 198 42 285

(51) Int. Cl.[7] ..... A47D 7/00; A47D 15/00; A63H 33/00

(52) U.S. Cl. ..... 5/93.1; 5/658; 446/227; D6/331

(58) Field of Search ..... 5/93.1, 53.1, 658; 446/227; D6/331

(56) References Cited

U.S. PATENT DOCUMENTS

| | | | | |
|---|---|---|---|---|
| D. 153,335 | * | 4/1949 | Brand | D6/331 |
| 2,308,608 | * | 1/1943 | Kennedy | 5/99.1 |
| 2,471,762 | * | 5/1949 | Merrett | 5/93.1 |
| 2,630,584 | | 3/1953 | Netel | 5/93.1 |
| 2,774,182 | * | 12/1956 | Beder | 446/227 |
| 2,789,391 | * | 4/1957 | Perry | 446/227 |
| 3,983,647 | | 10/1976 | Stubbmann | 40/28.1 |
| 4,664,640 | * | 5/1987 | Shindo et al. | 446/227 |
| 4,935,976 | | 6/1990 | Milman | 5/93.1 |
| 5,634,796 | | 6/1997 | Dollar | 5/658 |
| 5,802,634 | * | 9/1998 | Onishi et al. | 5/93.1 |
| 5,913,771 | * | 6/1999 | Nail | 5/53.1 |

FOREIGN PATENT DOCUMENTS

| | | | |
|---|---|---|---|
| 502 897 | | 5/1951 | (BE) . |
| 221080 | | 9/1924 | (GB) . |
| 511526 | | 8/1939 | (GB) . |
| 699619 | * | 11/1953 | (GB) 5/93.1 |

* cited by examiner

*Primary Examiner*—Alexander Grosz
(74) *Attorney, Agent, or Firm*—Morgan, Lewis & Bockius LLP

(57) ABSTRACT

The invention proposes a child's bed including at least one planar bed-framework element arranged perpendicularly to a lying surface. The invention also provides for at least one toy element to be integrated in the bed-framework element in a movable manner by means of guide members.

24 Claims, 5 Drawing Sheets

CRIB

FIELD OF THE INVENTION

The invention relates to a child's bed with at least one planar bed-framework element arranged perpendicularly to the lying surface.

BACKGROUND OF THE INVENTION

Children's beds of the type referred to in the introduction are known in a wide range of embodiments. Children's beds usually comprise a front side and rear side, which rise up beyond the lying surface, and bar-construction elements, which rise up correspondingly, on the sides in order that a small child cannot leave the bed of its own accord.

In hospitals, in particular, children are often forced to stay in such beds for the entire day. In order to avoid the situation where the children get bored, either toy figures or the like are fitted on the child's bed or they are simply laid in the bed. In many cases, however, the children throw the playthings out of the bed or dismantle the often insufficiently fastened toys.

As boredom sets in, the child then quickly has to be provided if necessary, by the individuals looking after it, with a new toy in order to amuse it further. During the night, this is not always immediately possible, as a result of which usually, for example, a parent is woken up by the fractious child.

In hospitals, in addition, there may be hygiene-related problems if toys are constantly falling onto the floor and are possibly difficult to disinfect.

SUMMARY OF THE INVENTION

The object of the invention is to ensure the availability of toys in a child's bed and thus to keep a child happy and amused.

This object is achieved by the features of claim 1.

Advantageous and expedient developments of the child's bed according to the invention are specified in the subclaims.

The invention takes as its departure point a child's bed with at least one planar bed-framework element arranged perpendicular to the lying surface. The basic idea of the invention, then, is that at least one toy element is integrated in the bed-framework element in a movable manner by means of guide members. This ensures the constant availability of the toy elements on the child's bed and that said elements are fitted such that they cannot be released, at least by a child. This allows the child to be distracted by a toy element which is always available, which makes it easier to amuse and look after the child. In particular when such a bed is used in a hospital, the bed, which is designed according to the invention so as to keep the child happy, aids a speedier recovery. Since a toy element no longer comes into contact with the floor, the abovedescribed hygiene-related problems are avoided.

In order to allow the invention to be retrofitted on an existing bed, it is further proposed that the at least one bed-framework element may be fastened releasably on an exiting bed-framework element. For example, an appropriate attachment frame may be fitted on an existing crib framework. Such an attachment frame may also be arranged, for example, on a playpen.

In a further refinement of the child's bed according to the invention, the guide members contain at least one guide rail on which a toy element is fitted in a displaceable, for example slidable, manner. It is likewise advantageous in this context if the guide members comprise two parallel guide rails between which at least one toy element is arranged in a displaceable manner. The guide rails advantageously run horizontally on the bed framework. This procedure has the advantage that, depending on the length of the guide rails, an entire bed-framework wall element or bar-construction element can be utilized by the child as a play arrangement.

It is further advantageous if the guide members comprise at least one pivot spindle for a toy element. The pivot spindle is preferably located in the plane of the planar bed-framework element. In a further preferred embodiment, the pivot spindle runs horizontally. This measure makes it possible to provide, for example, play panels which can then be rotated via the pivot spindle. In the case of relatively large play panels in particular, it is, moreover, particularly advantageous if these can be secured. This avoids the situation where a child gets caught in the play panel and possibly injures itself.

It is likewise favorable if the play panel can be secured in an inclined position, e.g. 30° in relation to the bed-framework element, with the result that a child within the bed can utilize this inclined play panel, for example, as a book rest.

In order to provide the child with a large variety of playing opportunities, it is, furthermore, advantageous if the bed-framework element and/or the at least one toy element are designed such that the toy element can easily be exchanged.

The at least one toy element is preferably a toy figure or a play panel.

The toy elements may preferably be arranged on a bed-framework element such that they can also be utilized by a child who is outside the bed, that is to say, in the case of cribs, in the bottom region of the bed-framework elements, possibly beneath the lying surface of the bed. In many cases, however, it is advantageous if the toy elements are arranged in a region of the bed-framework element which projects beyond the lying surface of the bed, with the result that a child within the bed can easily reach the toy element or elements.

In a particularly advantageous embodiment, the bed-framework element is a side element or a front side or rear side of a crib. The crib, for use in a hospital, is preferably designed with a high substructure.

Finally, in a preferred embodiment of the invention, it is advantageous if guide rails for the toy elements are arranged in the side elements and pivot spindles and/or guide rails for the toy elements are arranged in the front-wall and rear-wall elements.

BRIEF DESCRIPTION OF THE DRAWINGS

A number of exemplary embodiments of the invention are explained more specifically in the following description, with further advantages and details being specified, and are illustrated in the drawings, in which.

DETAILED DESCRIPTION OF THE PREFERRED EMBODIMENTS

Figure 1A:
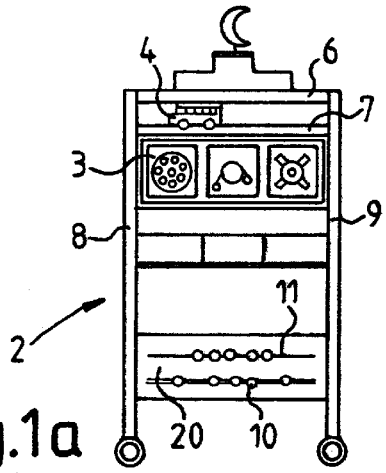
FIG. 1*a* shows a schematic illustration of a child's bed according to the present invention in front view.
Figure 1B:
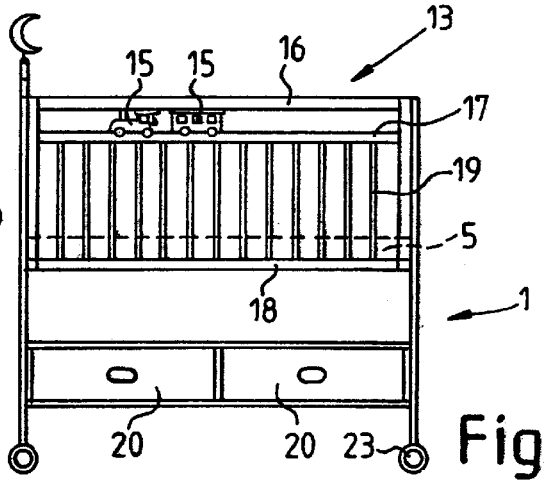
FIG. 1*b* shows a schematic illustration of a child's bed according to the present invention in a first side view.
Figure 1C:
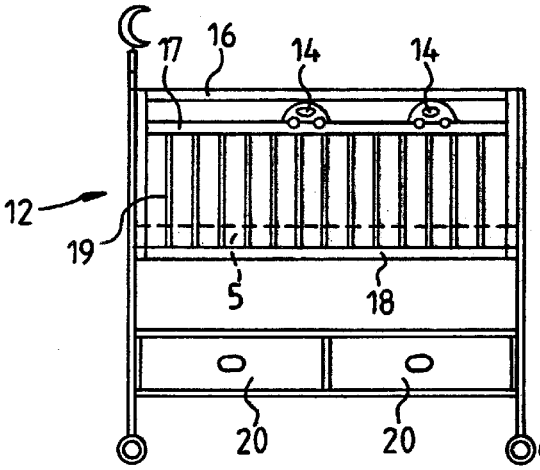
FIG. 1*c* shows a schematic illustration of a child's bed according to the present invention in a second side view.
Figure 1D:
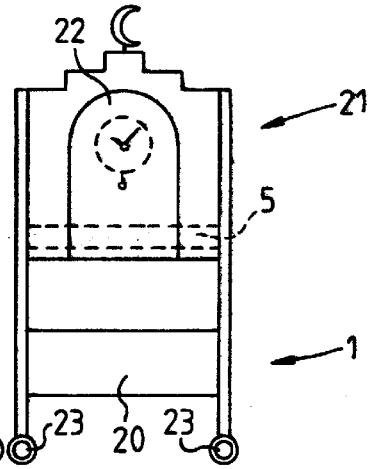
FIG. 1*d* shows a schematic illustration of a child's bed according to the present invention in rear view.

An exemplary embodiment of a child's bed according to the invention is illustrated in FIGS. 1*a–d* and FIGS. 2*a–c*. The child's bed here is, for example, one which is designed for a hospital and thus has a high substructure 1. Arranged in the foot-part element 2, above a mattress 5, is a pivotable play panel 3 and, above this, a displaceable toy FIG. 4 in the form of a bus. The toy FIG. 4 runs along guide members 6, 7, which constitute crossbar members of the foot-part element 2 at the same time. For the play panel 3, a pivot-spindle bearing means is accommodated in the vertical corner posts 8, 9 and in the play panel itself. In addition, displaceable playthings 10 are positioned on separate guide rails 11 beneath the mattress 5.

In the side parts 12, 13, toy FIGS. 14, 15 are likewise arranged in a displaceable manner along guide members 16, 17, which form the crossbars of the side parts 12, 13 at the same time. Moreover, the crossbar 17 forms, with a further crossbar 18, which runs parallel to it on the bottom edge of the mattress 5, the top and bottom borders, respectively, of bar-construction elements, with bars 19, which are arranged in the side parts 12, 13. In order to reinforce the substructure 1, drawers 20 are provided in the bottom region thereof.

As a further attraction for a child, the head-part element 21 has an integrated toy clock 22. This bed also has castors 23 so that it can be easily displaced.

Figures 2A, 2B, 2C:
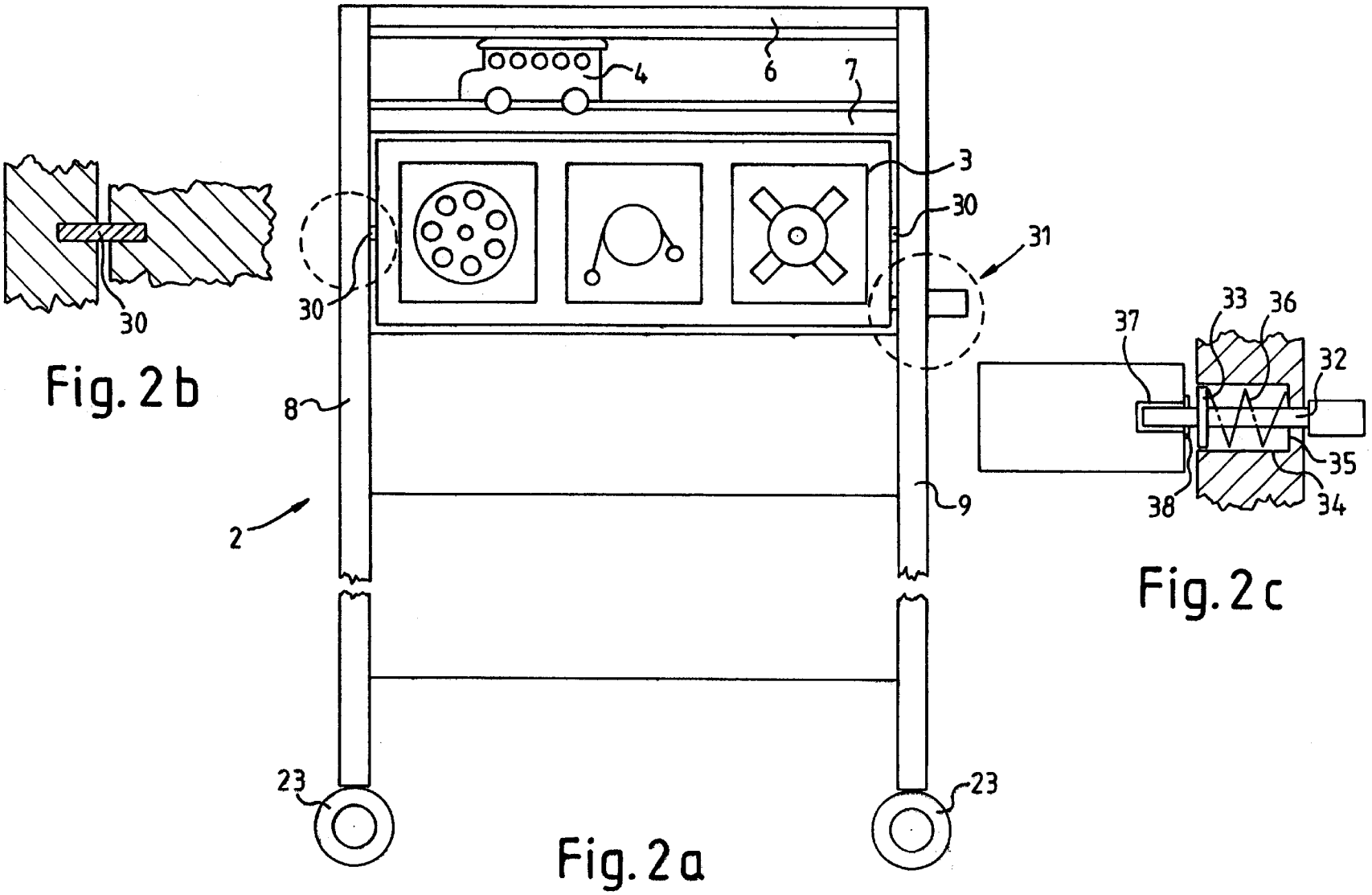
FIG. 2*a* shows an enlarged view of the foot-part element of the child's bed according to the present invention.
FIG. 2*b* shows an enlarged view of pivot spindle 30 of the child's bed according to the present invention.
FIG. 2*c* shows an enlarged view of arresting device 31 of the child's bed according to the present invention.

FIG. 2*a* shows an enlarged illustration of the foot-part element 2 from FIG. 1*a–d*. Furthermore, a pivot device for the play panel 3 with securing means is depicted on a further-enlarged scale in FIGS. 2*b* and *c*. The play panel 3 can be rotated via pivot spindles 30 which are mounted in the corresponding bores in the corner posts 8, 9 and in the play panel 3. In order to secure the rotatable play panel, an arresting device 31 is provided, and this comprises a sprung safety catch 32 which is mounted in a bore in the corner post 9 by means of a guide disk 33. The guide disk 33 and the base 35 of the bore 34 serve as a rest for a compression spring 36. By virtue of the safety catch 32 being pulled, the projecting part of the safety catch is pulled out of a bore 37 in the play panel 3, preferably to the extent where the play panel can be rotated in order, for example following a 180° rotation, to allow the safety catch 32 to engage again in a corresponding bore of the play panel. In order to avoid the situation where the safety catch 32 penetrates too far into the bore 37, the safety catch has a stop collar 38. This makes it possible for the two different sides of a play panel to be available to a child for play purposes.

FIGS. 3*a–b*, 4*a–b* and 5*a–b* illustrate three variants of a toy-figure guide in detail form and in a sectional view.

Figure 3B:
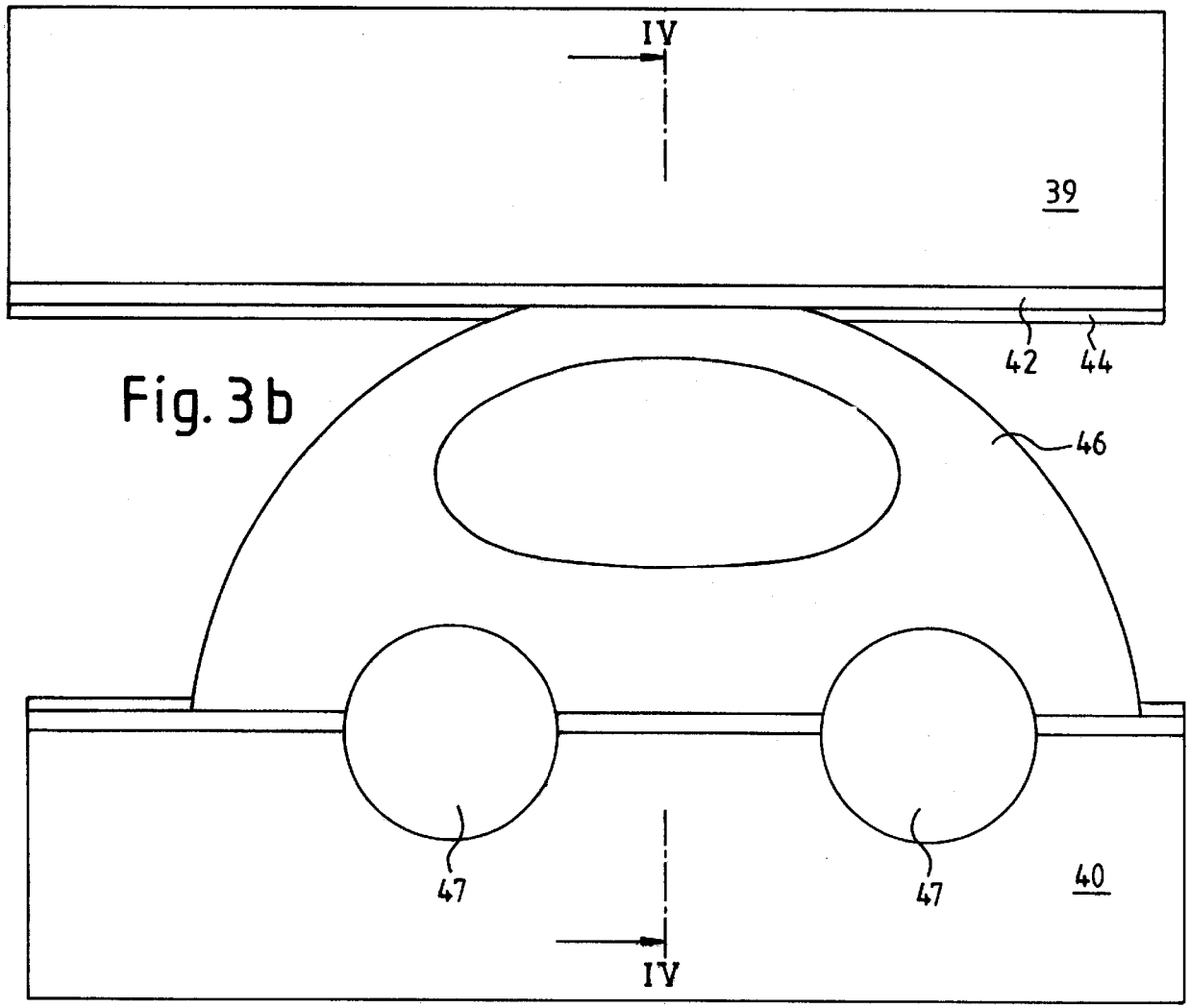
FIG. 3*b* shows a front view of the embodiment of the guide rail shown in FIG. 3*a;*
Figure 3A:
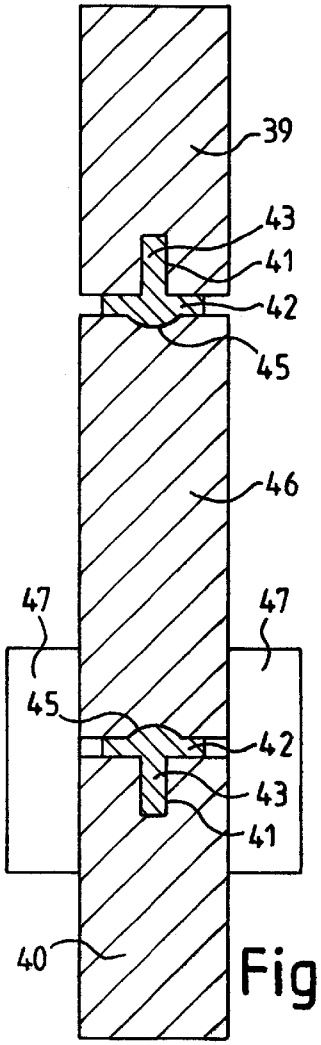
FIG. 3*a* shows a sectional view of an embodiment of a guide rail for accommodating a toy figure in a child's bed according to the present invention.

In FIGS. 3*a–b*, guide members 39, 40 have a U-shaped groove 41 into which in each case one elastic rubber guide element 42 is inserted via a matching, tongue-like nose. Instead of the nose 43, it is also possible to use, inter alia, stub-like elements. On the outside, the rubber guide elements 42 each have a slight convexity 44 which engages in a matching groove 45 of a toy FIG. 46, with the result that the toy figure (in this case a car) can slide, with some play, between the guide members 39, 40. By way of example, in the present case, the wheels 47 of the car 46 are additionally used for guidance purposes. The rest of the toy figure, in contrast, is located in the same plane as the guide members 39, 40.

Figure 4A:
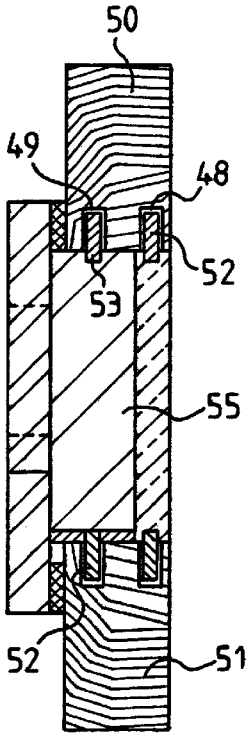
FIG. 4*a* shows a sectional view of another embodiment of a guide rail for accommodating a toy figure in a child's bed according to the present invention.
Figure 4B:
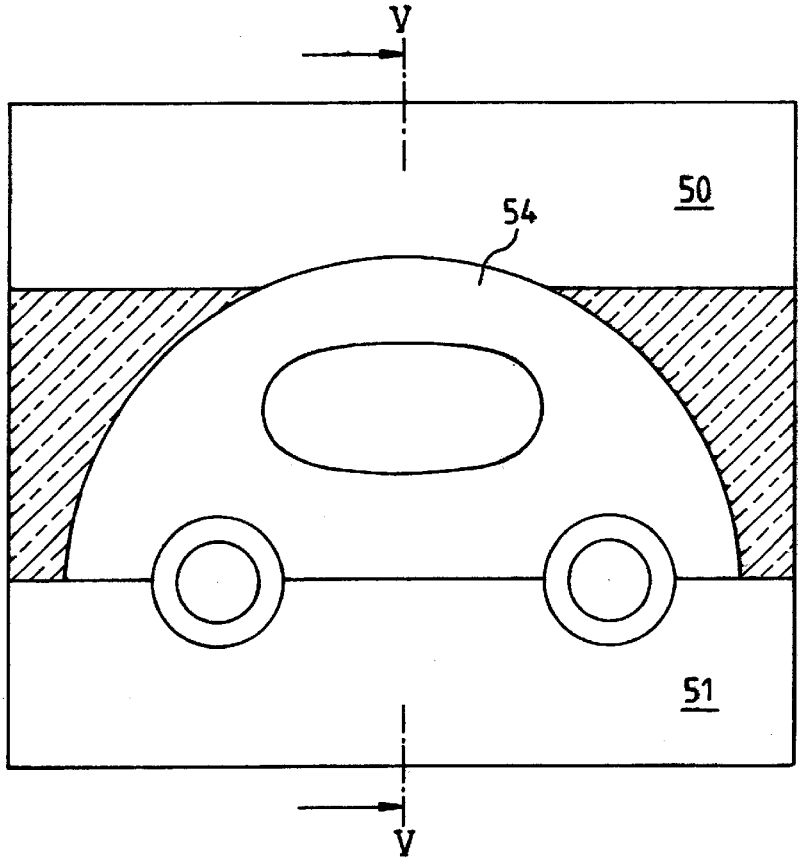
FIG. 4*b* shows a front view of the embodiment of the guide rail shown in FIG. 4*a;*

The exemplary embodiment of FIGS. 4*a–b* differs from the embodiment according to FIGS. 3*a–b* by in each case 2 grooves 48, 49 which are provided in guide members 50, 51 and in which in each case 2 tongues 52, 53 of the toy FIG. 54 engage. Instead of the tongues 52, 53, it is also possible to use pegs or the like. Furthermore, the toy figure has been attached to a plate 55 on which the tongues 52, 53 are arranged, with the result that the toy FIG. 54 also assists guidance along the members 50, 51.

Figure 5A:
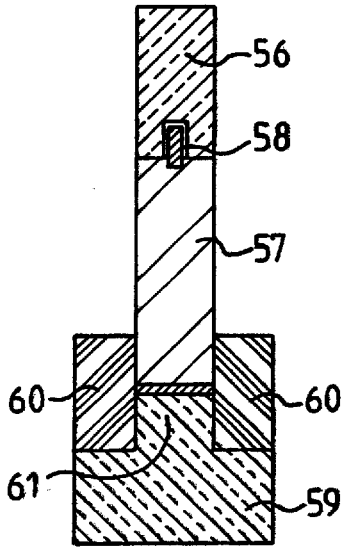
FIG. 5*a* shows a sectional view of another embodiment of a guide rail for accommodating a toy figure in a child's bed according to the present invention.
Figure 5B:
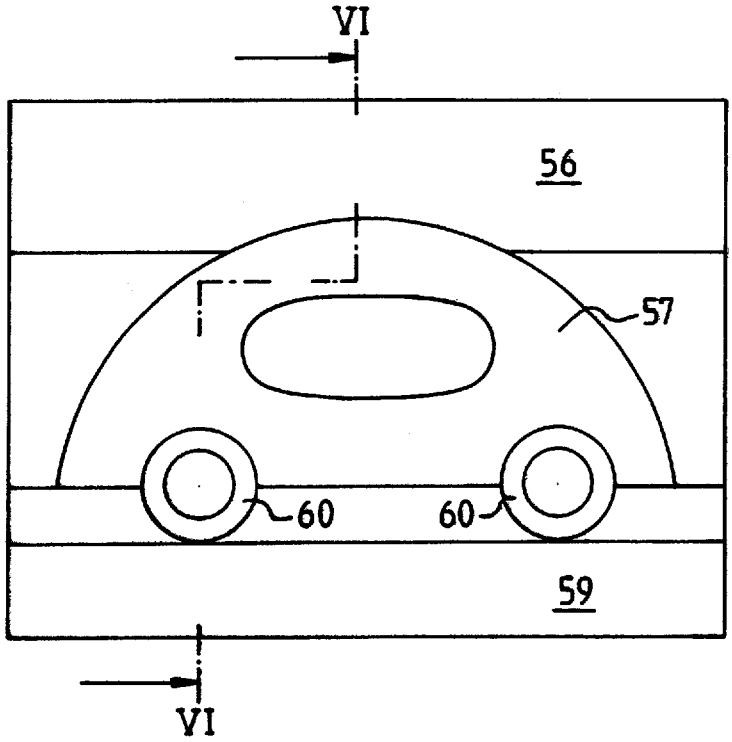
FIG. 5*b* shows a front view of the embodiment of the guide rail shown in fig. 5*a*.

In FIGS. 5*a–b*, a toy FIG. 57 is guided in a member 56 via a groove and tongue connection 58; instead of the groove and tongue connection, it is also possible to use a comparable connection, e.g. one or more pegs instead of the tongue, whereas the opposite guide member 59 is widened such that it terminates flush with four wheels 60. In this case, the wheels 60 on both sides form a type of groove in which a correspondingly narrow part of the guide member 61 is positioned, with the result that the toy FIG. 57 can slide, with some play, between the members 56, 59.

What is claimed is:

1. A child's bed comprising:

at least one planar bed-framework element arranged perpendicularly to a lying surface, said framework element having first and second vertically-extending corner posts and first and second horizontally-extending guide members arranged between said comer posts, said first guide member is above said second guide member and defines the upper edge of said bed-framework element; and at least one toy element integrated in the bed-framework element, wherein the at least one toy element is held in a movable manner by the first and second guide members.

2. The child's bed according to claim 1, wherein the at least one bed-framework element is fastened releasably on an existing bed-framework element.

3. The child's bed according to claim 1, wherein at least one of the guide members contains at least one guide rail on which at least one toy element is arranged in a displaceable manner.

4. The child's bed according to claim 3, wherein at least one of the guide rails runs horizontally on the bed-framework element.

5. The child's bed according to claim 3, further composing a front-portion, a rear-portion, and a side-portion between the front and rear portions, and wherein the at least one guide rail for the at least one toy element is arranged in the at least one bed-framework element, wherein said bed-framework element is the side-portion, the front-portion, or the rear-portion.

6. The child's bed according to claim 3, wherein the at least one guide rail extends substantially the entire width of the bed-framework element.

7. The child's bed according to claim 1, wherein at least two of the guide members comprise two parallel guide rails between which at least one toy element is arranged in a displaceable manner.

8. The child's bed according to claim 7, wherein the guide rails run horizontally on the bed-framework element.

9. The child's bed according to claim 7, wherein the guide rails extend substantially the entire width of the bed-framework element.

10. The child's bed according to claim 1, wherein the bed-framework element or the at least one toy element is designed such that the at least one toy element can easily be exchanged.

11. The child's bed according to claim 1, wherein the at least one toy element is a toy figure or a play panel.

12. The child's bed according to claim 1, wherein the at least one bed-framework element projects upward beyond a lying surface thereby defining a region, and the at least one toy element is arranged in this region.

13. The child's bed according to claim 1, further comprising a front-portion, a rear-portion, and a side-portion between the front and rear portions, and wherein the bed-framework element is the side-portion, the front-potion, or the rear-portion.

14. The child's bed according to claim 1, wherein the bed-framework element and the at least one toy element is designed such that the toy element can easily be exchanged.

15. A child's bed comprising:

at least one planar bed-framework element arranged perpendicularly to a lying surface, said framework element defining a side of a bed, the framework element having first and second vertically-extending corner posts and at least one pivot spindle coupled to at least one of said first and second corner posts; and at least one toy element pivotally mounted between said comer posts in a movable manner by means of said at least one pivot spindle.

16. The child's bed according to claim 15, wherein the at least one pivot spindle is located in a plane of the planar bed-framework element.

17. The child's bed according to claim 16, wherein the at least one pivot spindle runs horizontally.

18. The child's bed according to claim 15, wherein the at least one pivot spindle runs horizontally.

19. The child's bed according to claim 15, wherein the at least one pivotable toy element can be secured.

20. The child's bed according to claim 15, further comprising a front-portion, a rear-portion, and a side-portion between the front and rear portions, and wherein the pivot spindle is arranged in at least one bed-framework element, wherein said bed-framework element is the front-portion or the rear-portion.

21. The child's bed according to claim 15, wherein the at least one bed-framework element is fastened releasably on an existing bed-framework element.

22. The child's bed according to claim 15, wherein the bed-framework element or the at least one toy clement is designed such that the at least one toy element can easily be exchanged.

23. The child's bed according to claim 6, wherein the at least one toy element is a toy figure or a play panel.

24. The child's bed according to claim 6, wherein the bed-framework element and the at least one toy element is designed such that the toy element can easily be exchanged.

* * * * *